US007153107B1

(12) United States Patent
Maddox, Jr.

(10) Patent No.: US 7,153,107 B1
(45) Date of Patent: Dec. 26, 2006

(54) COMPRESSOR MUFFLER ASSEMBLY

(75) Inventor: Robert J. Maddox, Jr., Cartersville, GA (US)

(73) Assignee: RIC Investments, LLC, Wilmington, DE (US)

( * ) Notice: Subject to any disclaimer, the term of this patent is extended or adjusted under 35 U.S.C. 154(b) by 0 days.

(21) Appl. No.: 10/957,454

(22) Filed: Oct. 1, 2004

(51) Int. Cl.
*F04B 39/00* (2006.01)

(52) U.S. Cl. ..... 417/312; 181/281; 181/403

(58) Field of Classification Search ..... 417/312; 181/264, 269, 281, 403
See application file for complete search history.

(56) References Cited

U.S. PATENT DOCUMENTS 1,085,203 A * 1/1914 Gipple ..... 181/281
1,182,611 A * 5/1916 Williams et al. ..... 181/281
1,474,115 A * 11/1923 Heather ..... 181/281
2,723,723 A * 11/1955 Halliday et al. ..... 181/281
5,996,731 A 12/1999 Czabala et al.
6,382,931 B1 5/2002 Czabala et al.

FOREIGN PATENT DOCUMENTS

JP 58-160570 * 9/1983

* cited by examiner

*Primary Examiner*—Michael Koczo, Jr.
(74) *Attorney, Agent, or Firm*—Michael W. Haas

(57) ABSTRACT

A muffler assembly for a compressor that suppresses noise that would otherwise escape from the inlet of the compressor during its operation. The muffler assembly includes an intake conduit that has an inlet portion, an outlet portion adapted to couple to an inlet of a compressor, a longitudinal axis defined between the inlet portion and the outlet portion, and a passage defined through the intake conduit generally parallel to the longitudinal axis. A baffle is disposed in the intake conduit generally traversing the passage. The baffle is defined in a plane that is disposed at an angle with respect to the longitudinal axis. An opening is defined at least partially by the baffle and disposed generally proximate to the outlet portion of the intake conduit.

14 Claims, 4 Drawing Sheets

COMPRESSOR MUFFLER ASSEMBLY

BACKGROUND OF THE INVENTION

1. Field of the Invention

The present invention pertains to a muffler assembly for a compressor, and, in particular, to a muffler assembly disposed at the inlet of a compressor in an oxygen concentration system that decreases the noise level of the system to produce a more tranquil operating environment.

2. Description of the Related Art

Compressors are utilized for compressing air or other gas at a low pressure, such as atmospheric pressure, to a higher pressure for subsequent use. One such application is the use of a compressor with an oxygen concentrator, where air is drawn into the compressor from the surrounding environment through an inlet port of the compressor and then compressed and passed through an outlet of the compressor to a molecular sieve bed of the oxygen concentrator where oxygen is separated from the other constituents of air for use by a patient.

A typical compressor includes a housing that houses a connecting rod assembly and a piston assembly which compress the air. The piston assembly generally consists of a compressor head connected to a valve plate, a piston sleeve connected to the valve plate, and a piston within the piston sleeve that moves within the piston sleeve in an up and down cycle. Compressing the gas generates noise from a variety of sources. For instance, running the connecting rod assembly and sucking gas into the compressor during the downstroke of the piston generates noise through the compressor intake port. Many pistons utilize a reed valve in the valve plate for directing the gas flow in and out of the compressor. Air flowing through such a reed valve generates a sound that is continually repeated as a result of the reciprocating motion of the piston. Furthermore, compressing gas during the upstroke of the piston generates a noise that travels back through the compressor intake port, while the turbulent flow of the gas as it travels at high velocity into an output cylinder also generates acoustic noise in a pulse setting fashion. Accordingly, in a conventional compressor assembly, a muffler is generally connected somewhere in the compressor system for muffling the noise of the compressor.

Several attempts have been made to develop a muffler for compressors. For example, some efforts have included placing foam filters within enclosed chambers with the gas entering the compressor being drawing through the filters. While such mufflers generally filter very high frequencies of noise, they have little affect on lower frequency sounds. Furthermore, these assemblies require numerous parts and typically occupy a large amount of space, which adversely impact the desirability of the muffler.

Other attempts to reduce compressor noise have utilized non-dissipative mufflers for reducing sound within a specific frequency range. Such mufflers utilize a resonator that is tuned to maximize the amount of attenuation by adjusting the length and diameter of the outlet with respect to the sides of the cylinder chamber. While these types of resonators are effective, they generally require extensive design work on the particular compressor size and then only work on soundwaves of a particular frequency.

U.S. Pat. No. 5,996,731 ("the '731 patent") discloses a compressor muffler that utilizes a baffle and an attenuating element, both of which are provided in an intake conduit that is attached to the inlet of the compressor. The attenuating element is elongated and fits within an opening provided in the baffle. While this configuration is effective, it requires assembling the attenuating element within the intake conduit such that it is properly aligned in the opening of the baffle, which is a relatively cumbersome process. This configuration also does not minimize the space required for the muffler.

U.S. Pat. No. 6,382,931 ("the '931 patent") is similar to the '731 patent except that it eliminates the attenuating element and teaches providing various configurations for the opening or openings in the baffle. The '931 patent also teaches providing multiple baffles with offset opening to define a tortuous path in the intake conduit. As with the, '731 patent, this configuration requires a specially configured intake conduit and does not minimize the space required for the muffler.

While many of these mufflers are believed to reduce the compressor noise, they are generally either difficult to design, only effectively reduce the sound associated with a particular wave frequency, require many components which result in an increase cost of the muffler in both materials and assembly labor.

SUMMARY OF THE INVENTION

Accordingly, it is an object of the present invention to provide a muffler assembly that overcomes the shortcomings of conventional sound suppression techniques. This object is achieved according to one embodiment of the present invention by providing a muffler assembly for a compressor that includes an intake conduit having an inlet portion, an outlet portion that couples to an inlet of a compressor, a longitudinal axis defined between the inlet portion and the outlet portion, and a passage defined through the intake conduit generally parallel to the longitudinal axis. A baffle is disposed in the intake conduit such that the baffle generally traverses the passage. The baffle is defined in a plane that is disposed at an angle with respect to the longitudinal axis of the intake conduit. An opening is defined, at least partially, by the baffle and is disposed generally proximate to the outlet portion of the intake conduit. This configuration for the muffler assembly provides a simple, non-complex, and effective sound suppression device that allows a free flow of gas to the intake of the conduit.

It is a further object of the present invention to provide an oxygen concentrator system that incorporates the muffler assembly discussed above. The oxygen concentrator system also includes a compressor that has an inlet adapted to receive a flow of gas from an ambient environment and an outlet and a molecular sieve assembly coupled to the outlet of the compressor. A molecular sieve assembly separates the flow of gas from the compressor into components including a concentrated gas. The molecular sieve assembly also has an outlet that provides a flow of the concentrated gas to a user. The outlet portion of the muffler assembly couples to the inlet of the compressor. This configuration provides an effective noise suppression system, including low frequency noise, while permitting the necessary amount of gas flow to the compressor to ensure its proper operation.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF THE PRESENTLY PREFERRED EMBODIMENTS OF THE INVENTION

Figure 1:
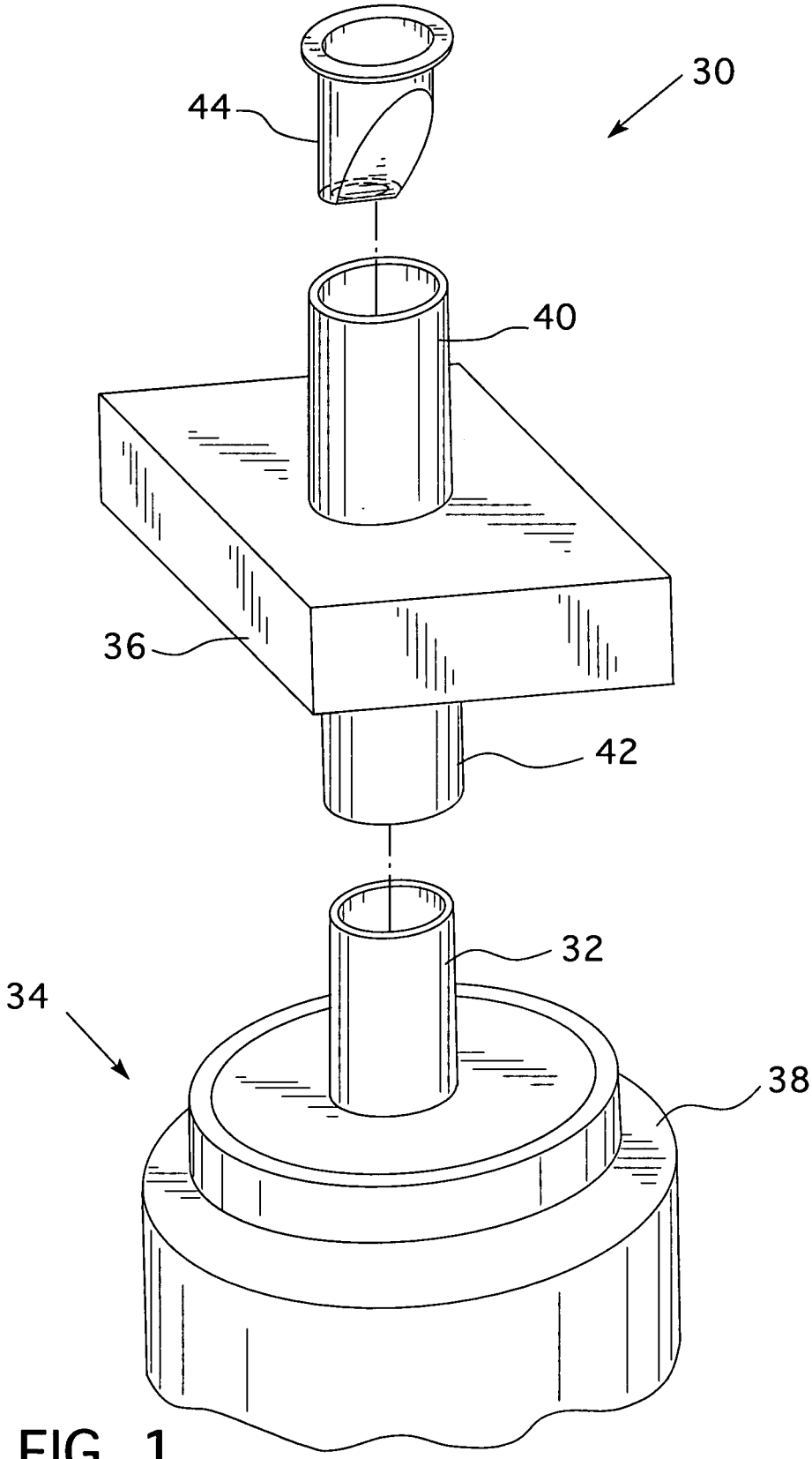
FIG. 1 is an exploded perspective view of a muffler assembly for use with a compressor according to the principles of the present invention.

FIG. 1 illustrates an exemplary embodiment of a muffler assembly, generally indicated at 30, according to the principles of the present invention. Muffler assembly 30 is shown as being attachable to an inlet 32 of a compressor 34. A filter element 36 is provided between the muffler assembly and the inlet of the compressor. In the illustrated embodiment, filter element 36 is any conventional filter, such as an HEPA filter, which removes smaller particles. The filter element can be comprised of a single filter or a combination of filters that are provided in a single housing or multiple housings.

The present invention contemplates that compressor 34 is any standard compressor, such as that provided by Thomas Industries of Sheboygen Wis. One exemplary use for such compressors are in an oxygen concentration system to pressurize a gas for delivery to a gas separation system. A typical gas separation system includes a molecular sieve assembly, typically in the form of a sieve bed, that is coupled to the outlet of the compressor. The molecular sieve assembly separates the flow of gas from the compressor into components, including a concentrated gas. The molecular sieve assembly has an outlet that provides a flow of the concentrated gas to a user.

In the illustrated exemplary embodiment, muffler assembly 30 is configured for matingly attaching to a compressor housing 38 in a hermetically sealed manner to prevent noise from the compressor from pervading through the ambient environment. More specifically, in this illustrated exemplary embodiment, muffler assembly 30 selectively mounts on an inlet portion 40 of filter element 36, and an outlet portion 42 of the filter element connects to inlet 32 of the compressor. It is to be understood, that the present invention contemplates that the muffler assembly can be attached directly to inlet 32, i.e., the filter assembly is optional and can be eliminated.

Figure 2:
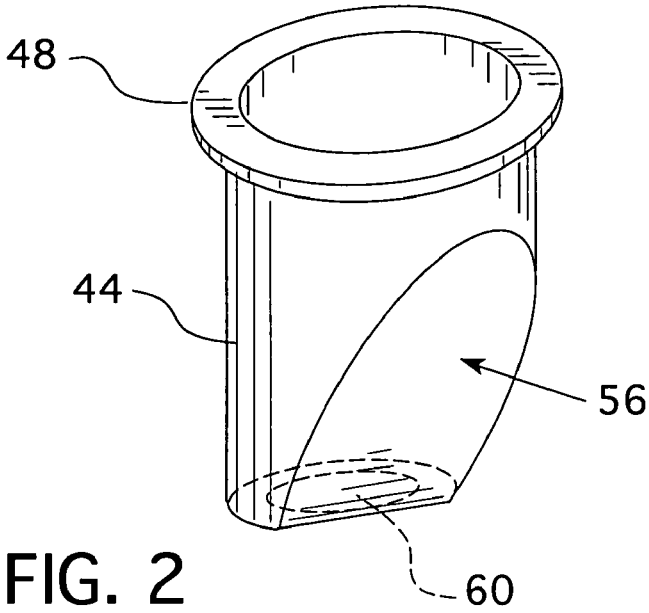
FIG. 2 is a perspective view of an inlet silencer for use with the muffler assembly of FIG. 1.
Figure 3:
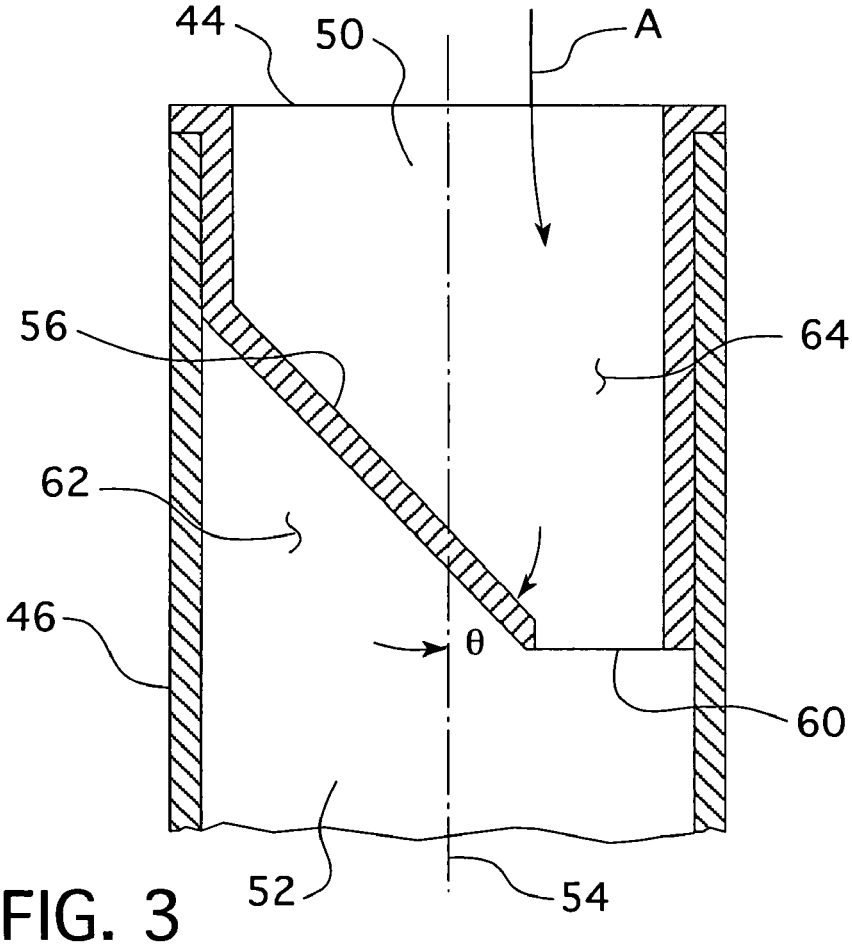
FIG. 3 is a cross-sectional view of the muffler assembly of FIG. 1.

Muffler assembly 30, which is shown in greater detail in FIGS. 2 and 3, includes an inlet silencer 44 and an intake conduit 46. In this embodiment, intake conduit 46 corresponds to inlet portion 40 of filter element 36. However, as noted above, the intake conduit can also correspond to inlet 32, if the filter element is omitted. In a presently preferred exemplary embodiment, intake conduit 46 is tubular. However, the present invention contemplates that the intake conduit can consist of any elongated geometric design, such as a rectangle, triangle, hexagonal, or the like.

Inlet silencer 44 inserts into intake conduit 46. An optional flange 48 on an inlet portion of the silencer limits the depth of insertion for the silencer into the intake conduit. Intake conduit includes an inlet portion 50 and an outlet portion 52. The outlet portion is configured to couple to an inlet of a compressor, either directly on indirectly (via a filter element), as noted above. A longitudinal axis 54 is defined between the inlet portion and the outlet portion of the intake conduit. A passage is defined through the intake conduit generally parallel to the longitudinal axis so that gas is permitted to flow through the muffler assembly, as indicated by arrow A.

Inlet silencer 32 includes a generally planar wall that forms a baffle 56 in the intake conduit. Baffle 56 generally traverses the passage defined in the intake conduit, and is defined in a plane that is disposed at an angle $\theta$ with respect to longitudinal axis 54. In an exemplary embodiment of the present invention, angle $\theta$ has a range of 40°–65°, and is preferably 54°. An opening 60 is defined at least partially by the baffle and is disposed in the muffler assembly downstream from inlet portion 50, i.e., generally proximate to outlet portion 52 of the intake conduit.

The angled relationship between the baffle and the walls of the intake conduit form a wedge-shaped area 62. A similar wedge-shaped area 64 is defined on a first side of the baffle proximate to inlet portion 50. Wedge-shaped area 64 tapers downward in a direction from the inlet portion to the outlet portion of the intake conduit. It is believed that the unique angled relationship of the baffle in the intake conduit provides an effective noise silencing feature similar to that provided by larger and more complex mufflers. In particular, the wedge-shaped baffle prevents low frequency noise from exiting the inlet of the compressor. This configuration also allows the necessary flow of gas from the ambient atmosphere into the compressor through the muffler, while minimizing the amount of space needed by the muffler assembly to provide the sound reduction and gas flow functions.

Figure 4:
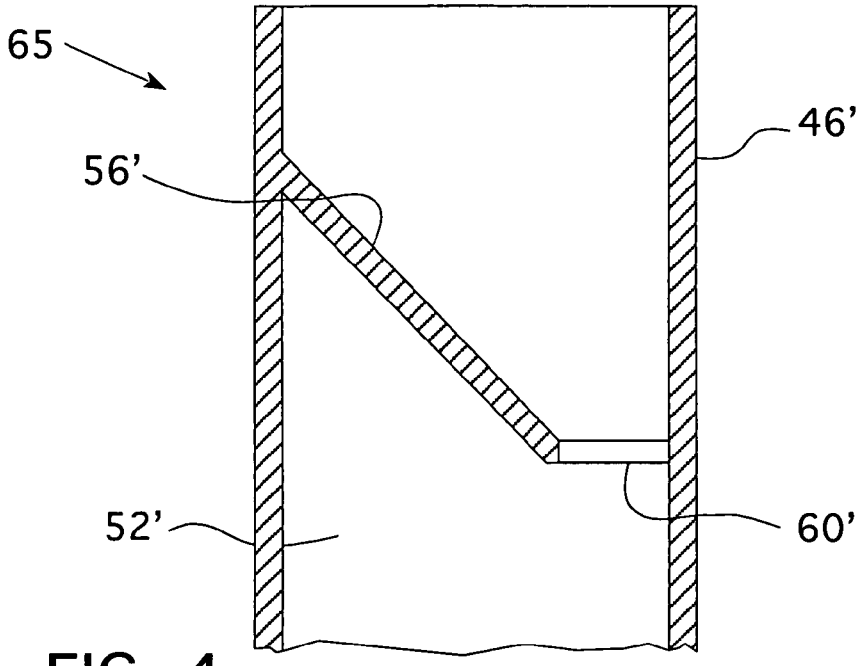
FIG. 4 is a cross-sectional view of a second embodiment of a muffler assembly according to the principles of the present invention.

FIG. 4 illustrates a second embodiment of a muffler assembly 65 according to the principles of the present invention. This embodiment is generally similar to that shown in FIGS. 1–3 except that in this embodiment, the inlet silencer has been eliminated and the features of the silencer are integrated into the intake conduit. Muffler assembly 65 includes a baffle 56' that is integral with a wall of intake conduit 46'. In this embodiment, opening 60' is defined between the baffle and the wall of the intake conduit. As in the previous embodiment, an outlet portion 52' of the intake conduit coupled to the inlet of the compressor of the filter. Of course, of other components are provided in the inlet channel to the compressor, the output portion of the intake conduit could also couple to those components.

Figure 5:
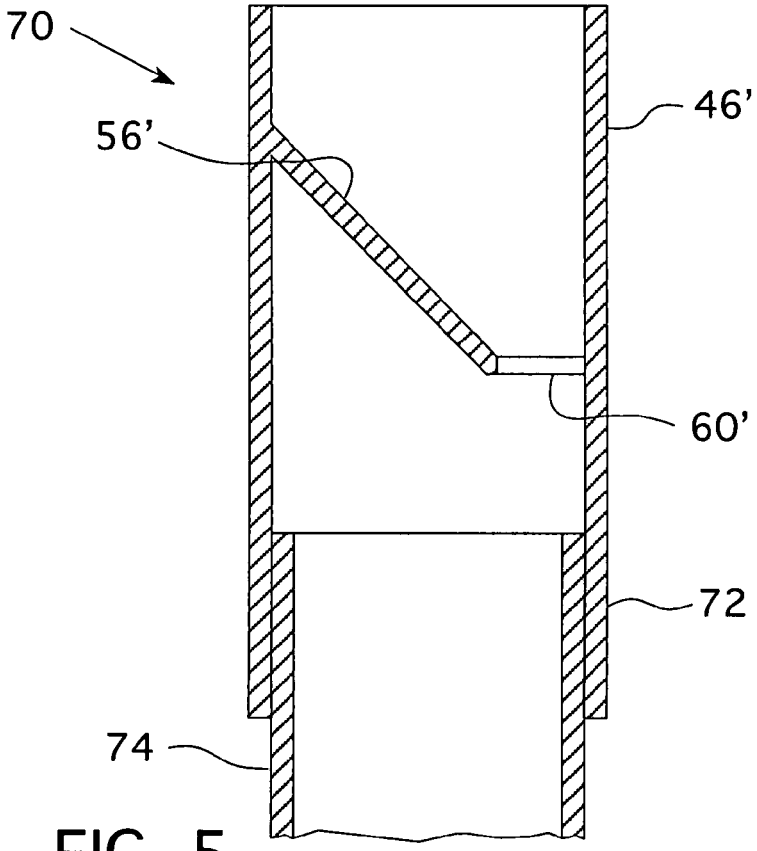
FIG. 5 is a cross-sectional view of a third embodiment of a muffler assembly according to the principles of the present invention.

FIG. 5 illustrates a third embodiment of a muffler assembly 70 according to the principles of the present invention. This embodiment is generally similar to that shown in FIGS. 1–4 except that in this embodiment, the inlet silencer has been eliminated and the features of the silencers are integrated into the intake conduit and the intake conduit is formed as a discrete muffler element 66 that can be attached anywhere along the intake path to the compressor. For example, muffler element 66 can be provided at the inlet of the filter element or between the filter element and the inlet of the compressor. In the illustrated embodiment, an end portion 72 of muffler element 66 is friction fit on a conduit 74, which corresponds, for example, to inlet 32 or inlet portion 40. It is to be understood that the present invention contemplates providing any mechanism for attaching the muffler element to a conduit and maintaining this attachment. This embodiment of the present invention provides a high degree of modularity in the design of the noise suppression system.

Figure 6:
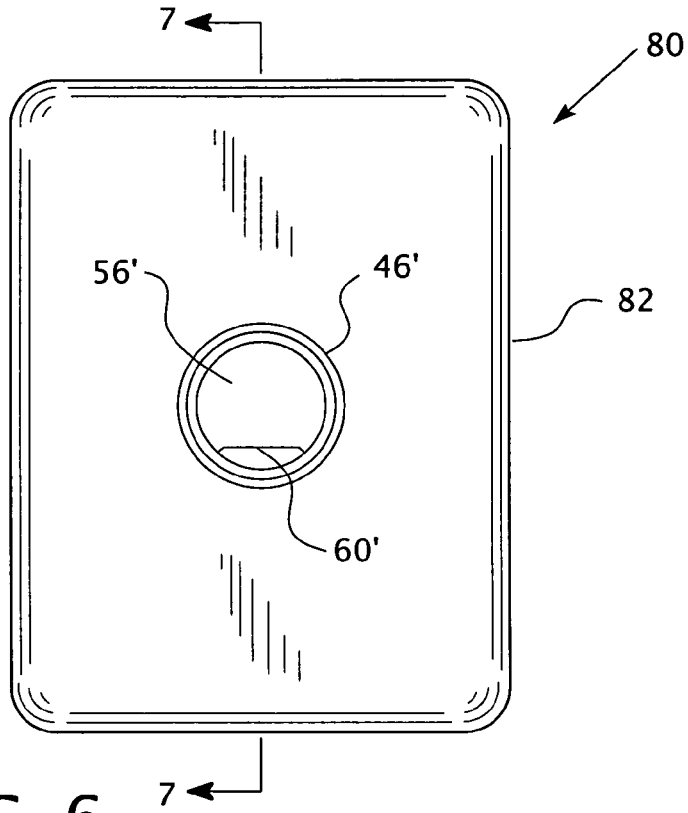
FIG. 6 is a top view of a forth embodiment of a muffler assembly according to the principles of the present invention.
Figure 7:
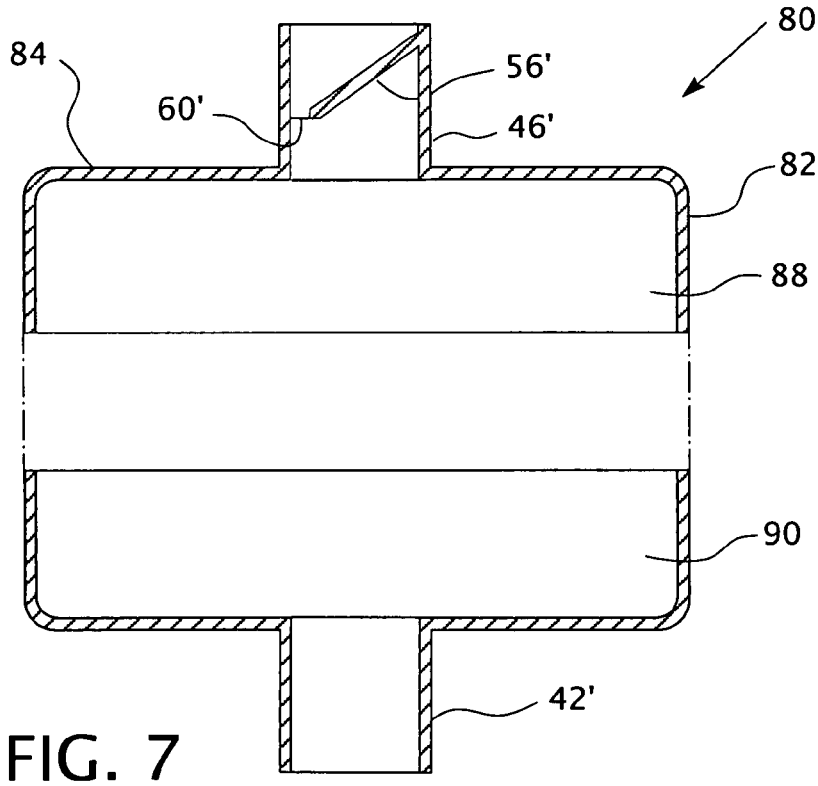
FIG. 7 is a cross-sectional, exploded view of the muffler assembly taken along line 7—7 of FIG. 6.

FIGS. 6 and 7 illustrate a forth embodiment of a muffler assembly 80 according to the principles of the present invention. In this embodiment, the components of the muffler assembly are integrated with a filter housing 82. Filter housing 82 preferably corresponds to a housing of filter element 36 that couples to the inlet of the compressor. See FIG. 1. In an exemplary configuration for this embodiment, baffle 56' is integral with intake conduit 46', and the intake conduit is integral with the filter housing. This embodiment provides the muffler assembly as a feature that is built into the filter element, thereby maximizing the space reduction advantages of the present invention. A filter material (not shown) is provided in a chamber 84 defined by the filter housing.

In this embodiment, filter housing 82 includes a first housing portion 88 and a second housing portion 90 that join together to define the housing having chamber 84 in which the filter material is located. An outlet 42' is provided on second housing portion 90 that couples to inlet 32 of the compressor. It can be appreciated that the filter housing can be formed from additional components having configurations other than that illustrated in FIGS. 6 and 7. In addition, the technique by which the components of the housing are joined can be any conventional technique, including permanent and selective attachment between the various portions of the housing. Selective attachment of the housing portions provides the capability of disassembling the housing so that it can be easily cleaned and/or so that the filter or filters contained in the housing can be readily replaced.

In an exemplary embodiment of the present invention, the muffler assembly is formed from a plastic. Of course, the present invention contemplates that the muffler assembly, or portions thereof, can be formed form other materials or combinations of materials. While not shown, the present invention contemplates that other components, such as a pre-filter, can be provided at the inlet of the muffler assembly without deviating from the principles of the present invention or compromising the function of the muffler assembly.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims.

What is claimed is:

1. A muffler assembly for a compressor, comprising:

an intake conduit having an inlet portion, an outlet portion, a longitudinal axis defined between the inlet portion and the outlet portion, and a passage defined through the intake conduit generally parallel to the longitudinal axis;

a baffle disposed in the intake conduit generally traversing the passage, wherein the baffle is defined in a plane that is disposed at an acute angle with respect to the longitudinal axis, and wherein the baffle is operatively coupled to an insert that is adapted to be inserted into the intake conduit;

an opening defined at least partially by the baffle and disposed generally proximate to the outlet portion of the intake conduit;

a filter housing having an inlet operatively coupled to the outlet portion of the intake conduit and an outlet;

a filter disposed in the filter housing; and an inlet conduit having an inlet portion adapted to be coupled to the outlet portion of the filter housing and an outlet portion adapted to be coupled to a compressor.

2. The muffler assembly of claim 1, wherein the intake conduit is generally cylindrical.

3. The muffler assembly of claim 1, wherein the filter housing is integral with the intake conduit.

4. The muffler assembly of claim 1, wherein the baffle is disposed in the passage such that a wedge-shaped area defined in the passage between the baffle and a wall of the intake conduit on a first side of the baffle proximate to the inlet portion tapers in a direction from the inlet portion to the outlet portion.

5. The muffler assembly of claim 1, wherein an angle between the plane and the longitudinal axis has a range of 40°–65°.

6. A muffler assembly for a compressor comprising:

an intake conduit having an inlet portion, an outlet portion, a longitudinal axis defined between the inlet portion and the outlet portion, and a passage defined through the intake conduit generally parallel to the longitudinal axis;

a baffle disposed in the intake conduit generally traversing the passage, wherein the baffle is defined in a plane that is disposed at an acute angle with respect to the longitudinal axis, and wherein the baffle is operatively coupled to an insert that is adapted to be inserted into the intake conduit, wherein the baffle is integral with the intake conduit;

an opening defined at least partially by the baffle and disposed generally proximate to the outlet portion of the intake conduit; and a filter housing having an inlet operatively coupled to the outlet portion of the intake conduit and an outlet;

a filter disposed in the filter housing; and an inlet conduit having an inlet portion adapted to be coupled to the outlet portion of the filter housing and an outlet portion adapted to be coupled to a compressor.

7. The muffler assembly of claim 6, wherein the filter housing is integral with the intake conduit.

8. An oxygen concentrator system comprising:

(a) a compressor having an inlet adapted to receive a flow of gas from an ambient environment and an outlet;

(b) a molecular sieve assembly operatively coupled to the outlet of the compressor, wherein the molecular sieve assembly separates the flow of gas from the compressor into components including a concentrated gas, and wherein the molecular sieve assembly has an outlet adapted to provide a flow of the concentrated gas to a user;

(c) a filter housing having an inlet and an outlet, wherein the outlet of the filter housing is operatively coupled to the inlet of the compressor;

(d) a muffler assembly for a compressor comprising:

(1) an intake conduit having an inlet portion, an outlet portion adapted to be coupled to the inlet of the filter housing, a longitudinal axis defined between the inlet portion and the outlet portion, and a passage defined through the intake conduit generally parallel to the longitudinal axis, (2) a baffle disposed in the intake conduit generally traversing the passage, wherein the baffle is defined in a plane that is disposed at an acute angle with respect to the longitudinal axis, wherein the baffle is operatively coupled to an insert that is adapted to be inserted into the intake conduit, and (3) an opening defined at least partially by the baffle and disposed generally proximate to the outlet portion of the intake conduit;

(e) a filter disposed in the filter housing; and (f) an inlet conduit having an inlet portion adapted to be coupled to the outlet portion of the filter housing and an outlet portion adapted to be coupled to a compressor.

9. The system of claim 8, wherein the intake conduit is generally cylindrical.

10. The system of claim 8, wherein the filter housing is integral with the intake conduit.

11. The system of claim 8, wherein the baffle is disposed in the passage such that a wedge-shaped area defined in the passage between the baffle and a wall of the intake conduit on a first side of the baffle proximate to the inlet portion tapers in a direction from the inlet portion to the outlet portion.

12. The system of claim 8, wherein an angle between the plane and the longitudinal axis has a range of 40°–65°.

13. An oxygen concentrator system comprising:

(a) a compressor having an inlet adapted to receive a flow of gas from an ambient environment and an outlet;

(b) a molecular sieve assembly operatively coupled to the outlet of the compressor, wherein the molecular sieve assembly separates the flow of gas from the compressor into components including a concentrated gas, and wherein the molecular sieve assembly has an outlet adapted to provide a flow of the concentrated gas to a user;

(c) a filter housing having an inlet and an outlet, wherein the outlet of the filter housing is operatively coupled to the inlet of the compressor;

(d) a muffler assembly for a compressor comprising:

(1) an intake conduit having an inlet portion, an outlet portion adapted to be coupled to the inlet of the filter housing, a longitudinal axis defined between the inlet portion and the outlet portion, and a passage defined through the intake conduit generally parallel to the longitudinal axis, (2) a baffle disposed in the intake conduit generally traversing the passage, wherein the baffle is defined in a plane that is disposed at an acute angle with respect to the longitudinal axis, wherein the baffle is integral with the intake conduit, and (3) an opening defined at least partially by the baffle and disposed generally proximate to the outlet portion of the intake conduit;

(e) a filter disposed in the filter housing; and (f) an inlet conduit having an inlet portion adapted to be coupled to the outlet portion of the filter housing and an outlet portion adapted to be coupled to a compressor.

14. The system of claim 8, wherein the filter housing is integral with the intake conduit.

* * * * *